US011828150B2

(12) United States Patent
Bolt

(10) Patent No.: US 11,828,150 B2
(45) Date of Patent: Nov. 28, 2023

(54) SMART MANIFOLD

(71) Applicant: NATIONAL OILWELL VARCO, L.P., Houston, TX (US)

(72) Inventor: Travis Lee Bolt, Conroe, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 36 days.

(21) Appl. No.: 17/597,033

(22) PCT Filed: Jun. 30, 2020

(86) PCT No.: PCT/US2020/040336
§ 371 (c)(1),
(2) Date: Dec. 22, 2021

(87) PCT Pub. No.: WO2021/003178
PCT Pub. Date: Jan. 7, 2021

(65) Prior Publication Data

US 2022/0298904 A1 Sep. 22, 2022

Related U.S. Application Data

(60) Provisional application No. 62/869,455, filed on Jul. 1, 2019.

(51) Int. Cl.
*E21B 43/26* (2006.01)
*E21B 43/267* (2006.01)

(52) U.S. Cl.
CPC ..... *E21B 43/2607* (2020.05); *E21B 43/267* (2013.01)

(58) Field of Classification Search
CPC .... E21B 43/26; E21B 43/2607; E21B 43/267; E21B 41/0085; E21B 43/00
See application file for complete search history.

(56) References Cited

U.S. PATENT DOCUMENTS

RE19,132 E 4/1934 McGuirk et al.
2,862,731 A 12/1958 Hedden et al.
(Continued)

FOREIGN PATENT DOCUMENTS

CA 2605260 C 6/2011
CN 109025944 A 12/2018
(Continued)

OTHER PUBLICATIONS

"U.S. Appl. No. 16/214,930, Advisory Action dated Oct. 20, 2021", 4 pgs.
(Continued)

*Primary Examiner* — Zakiya W Bates
(74) *Attorney, Agent, or Firm* — Schwegman Lundberg & Woessner, P.A.

(57) ABSTRACT

A smart manifold for frac operations may include a support structure and a fluid management system arranged on the support structure. The fluid management system may be configured for receiving low-pressure frac fluid from a fluid processing system, delivering the low-pressure fluid to a plurality of pressurization units, receiving high-pressure fluid from the plurality of pressurization units, and delivering the high-pressure fluid to a well head. The smart manifold may also include a power management system arranged on the support structure. The power management system may be configured for receiving power for frac operations and for delivering power to each of the plurality of pressurization units.

20 Claims, 14 Drawing Sheets

(56) References Cited

U.S. PATENT DOCUMENTS

| | | | |
|---|---|---|---|
| 2,937,444 | A | 5/1960 | Kern |
| 3,458,219 | A | 7/1969 | Wesch |
| 3,572,380 | A | 3/1971 | Jackson et al. |
| 3,752,507 | A | 8/1973 | Maurer et al. |
| 3,776,578 | A | 12/1973 | Jessup et al. |
| 4,354,698 | A | 10/1982 | Linder et al. |
| 4,391,297 | A | 7/1983 | Knight |
| 4,496,176 | A | 1/1985 | Weinhold |
| 4,844,133 | A | 7/1989 | Von Meyerinck et al. |
| 5,577,775 | A | 11/1996 | Pearson et al. |
| 5,738,178 | A | 4/1998 | Williams et al. |
| 7,007,753 | B2 | 3/2006 | Robichaux et al. |
| 7,654,583 | B2 | 2/2010 | Kvamme et al. |
| 8,146,665 | B2 | 4/2012 | Neal |
| 8,590,556 | B2 | 11/2013 | Kendrick |
| 10,408,031 | B2 | 9/2019 | Oehring et al. |
| 2004/0094898 | A1 | 5/2004 | Zheng |
| 2009/0041588 | A1 | 2/2009 | Hunter et al. |
| 2010/0310384 | A1 | 12/2010 | Stephenson et al. |
| 2010/0320699 | A1 | 12/2010 | Takeda et al. |
| 2012/0060929 | A1 | 3/2012 | Kendrick |
| 2012/0099954 | A1 | 4/2012 | Teichrob et al. |
| 2013/0284455 | A1 | 10/2013 | Kajaria et al. |
| 2014/0023463 | A1 | 1/2014 | Oren |
| 2014/0041317 | A1 | 2/2014 | Pham et al. |
| 2014/0048158 | A1 | 2/2014 | Baca et al. |
| 2014/0290768 | A1 | 10/2014 | Randle et al. |
| 2015/0000766 | A1 | 1/2015 | Arizpe et al. |
| 2015/0336747 | A1 | 11/2015 | Teichrob et al. |
| 2016/0102537 | A1 | 4/2016 | Lopez |
| 2016/0160889 | A1 | 6/2016 | Hoffman et al. |
| 2016/0170403 | A1 | 6/2016 | Lopez et al. |
| 2016/0281484 | A1* | 9/2016 | Lestz ..... E21B 43/26 |
| 2017/0074074 | A1 | 3/2017 | Joseph et al. |
| 2017/0291780 | A1 | 10/2017 | Sherwood et al. |
| 2017/0334639 | A1 | 11/2017 | Hawkins et al. |
| 2018/0045331 | A1 | 2/2018 | Lopez et al. |
| 2018/0187507 | A1 | 7/2018 | Hill et al. |
| 2018/0223640 | A1 | 8/2018 | Keihany et al. |
| 2018/0283151 | A1 | 10/2018 | Cook et al. |
| 2018/0284817 | A1 | 10/2018 | Cook et al. |
| 2018/0298731 | A1 | 10/2018 | Bishop |
| 2019/0169971 | A1 | 6/2019 | Oehring et al. |
| 2020/0182385 | A1 | 6/2020 | Westgarth et al. |
| 2020/0355321 | A1 | 11/2020 | Zerkus et al. |
| 2021/0040830 | A1 | 2/2021 | Mu et al. |
| 2021/0354910 | A1 | 11/2021 | Grimes et al. |
| 2021/0396223 | A1 | 12/2021 | Yeung et al. |
| 2022/0356791 | A1* | 11/2022 | Coli ..... E21B 43/26 |

FOREIGN PATENT DOCUMENTS

| | | | |
|---|---|---|---|
| CN | 113167420 | A | 7/2021 |
| EP | 1872047 | A2 | 1/2008 |
| GB | 1258305 | A | 12/1971 |
| GB | 2341653 | A | 3/2000 |
| WO | WO-2013095123 | A1 | 6/2013 |
| WO | 2017039692 | A1 | 3/2017 |
| WO | WO-2018074995 | A1 | 4/2018 |
| WO | 2019112554 | A1 | 6/2019 |
| WO | 2019147603 | A1 | 8/2019 |
| WO | WO-2020056360 | A1 | 3/2020 |
| WO | WO-2020120512 | A1 | 6/2020 |
| WO | WO-2021003178 | A1 | 1/2021 |
| WO | WO-2021003179 | A1 | 1/2021 |

OTHER PUBLICATIONS

"U.S. Appl. No. 16/214,930, Final Office Action dated Aug. 2, 2021", 14 pgs.
"U.S. Appl. No. 16/214,930, Non Final Office Action dated Jan. 26, 2021", 16 pgs.
"U.S. Appl. No. 16/214,930, Non Final Office Action dated Dec. 13, 2021", 15 pgs.
"U.S. Appl. No. 16/214,930, Response filed Apr. 22, 2021 to Non Final Office Action dated Jan. 26, 2021", 8 pgs.
"U.S. Appl. No. 16/214,930, Response filed Oct. 1, 2021 to Final Office Action dated Aug. 2, 2021", 9 pgs.
"U.S. Appl. No. 16/214,930, Response filed Nov. 2, 2021 to Advisory Action dated Oct. 20, 2021", 9 pgs.
"U.S. Appl. No. 16/214,930, Response filed Dec. 7, 2020 to Restriction Requirement dated Oct. 7, 2020", 6 pgs.
"U.S. Appl. No. 16/214,930, Restriction Requirement dated Oct. 7, 2020", 10 pgs.
"International Application Serial No. PCT/EP2019/084518, International Search Report dated Mar. 9, 2020", 5 pgs.
"International Application Serial No. PCT/EP2019/084518, Written Opinion dated Mar. 9, 2020", 7 pgs.
"International Application Serial No. PCT/US2019/051158, International Preliminary Report on Patentability dated Sep. 30, 2020", 4 pgs.
"International Application Serial No. PCT/US2019/051158, International Search Report dated Jan. 6, 2020", 4 pgs.
"International Application Serial No. PCT/US2019/051158, Invitation to Pay Additional Fees dated Oct. 28, 2019", 2 pgs.
"International Application Serial No. PCT/US2019/051158, Response filed Jul. 13, 2020 to Written Opinion dated Jan. 6, 2020", 3 pgs.
"International Application Serial No. PCT/US2019/051158, Written Opinion dated Jan. 6, 2020", 6 pgs.
"International Application Serial No. PCT/US2020/040336, International Search Report dated Sep. 25, 2020", 3 pgs.
"International Application Serial No. PCT/US2020/040336, Written Opinion dated Sep. 25, 2020", 6 pgs.
"International Application Serial No. PCT/US2020/040338, International Preliminary Report on Patentability dated Jul. 12, 2021", 7 pgs.
"International Application Serial No. PCT/US2020/040338, International Search Report dated Sep. 25, 2020", 3 pgs.
"International Application Serial No. PCT/US2020/040338, Written Opinion dated Sep. 25, 2020", 6 pgs.
"U.S. Appl. No. 17/247,769, Examiner Interview Summary dated Apr. 22, 2022".
"U.S. Appl. No. 17/247,769, Response filed Apr. 25, 2022 to Non Final Office Action dated Jan. 25, 2022".
"International Application Serial No. PCT/US2020/040336, International Preliminary Report on Patentability dated Jan. 13, 2022", 8 pgs.
"U.S. Appl. No. 17/247,769, Non Final Office Action dated Jan. 25, 2022", 10 pgs.
"U.S. Appl. No. 16/214,930, Response filed Mar. 14, 2022 to Non Final Office Action dated Dec. 13, 2021", 8 pgs.
"International Application Serial No. PCT/US2021/073083, International Search Report dated Feb. 28, 2022", 6 pgs.
"International Application Serial No. PCT/US2021/073083, Written Opinion dated Feb. 28, 2022", 6 pgs.

* cited by examiner

SMART MANIFOLD

CROSS-REFERENCE TO RELATED APPLICATIONS

The present application is a U.S. National Stage Filing under 35 U.S.C. 371 from International Application No. PCT/US2020/040336, filed Jun. 30, 2020, which claims priority to U.S. Provisional Patent Application No. 62/869,455 filed on Jul. 1, 2019 and entitled Smart Manifold, the content each of which are hereby incorporated by reference herein in their entirety.

TECHNOLOGICAL FIELD

The present application relates to frac operations. More particularly, the present application relates to managing the delivery of fluid and power to frac pumps adapted to deliver high-pressure fluid to a wellhead. Still more particularly, the present application relates to a combined manifold system for managing the delivery of fluid and power to frac pumps.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Frac solutions for producing oil from oil wells continue to develop and new technologies and changes to systems, new systems, and varieties of equipment have been incorporated. However, the fundamental concept of frac operations is relatively rudimentary and involves forcing grit-filled fluid into a well at a sufficiently high pressure to crack the rock formation in the well. The grit-filled fluid then flows into the cracks and the grit gets stuck there, which holds the cracks open and allows oil to flow through the cracks and out of the well. Given this relatively rudimentary process, a lot can be accomplished by somewhat haphazardly stringing equipment together with hoses and power cords. As systems have gotten bigger and more powerful, more hoses and power cords have become necessary and have been added to the systems. Current Frac operations may commonly have a large number of frac pumps contributing to pressurize the frac fluid. Each pump may have a low-pressure fluid supply line and a power line supply the pump and each pump may also have a high-pressure fluid line leaving the pump to carry the high-pressure fluid to the well. The individual supply lines can allow for flexibility of pump locations and numbers. However, where 8, 10, 12, or more pumps are present on site, the litany of fluid and power lines draped across the site creates a messy, sometimes unorganized, potentially dangerous, and obstructive web on the ground and across the frac site.

SUMMARY

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In one or more embodiments, a smart manifold for frac operations may include a support structure and a fluid management system arranged on the support structure. The fluid management system may be configured for receiving low-pressure frac fluid from a fluid processing system, delivering the low-pressure fluid to a plurality of pressurization units, receiving high-pressure fluid from the plurality of pressurization units, and delivering the high-pressure fluid to a well head. The smart manifold may also include a power management system arranged on the support structure and configured for receiving power for frac operations and for delivering power to each of the plurality of pressurization units.

In one or more embodiments, a frac system may include a fluid source configured to combine water, chemicals, and proppant, a power source configured for generating electrical power, a selected number of pressurization units configured to pressurize fluid, and a central manifold. The central manifold may be in fluid communication with the fluid source via a number of fluid lines less than the selected number of pressurization units. The central manifold may also be in electrical communication with the power source via a number of power supply lines less than the number of pressurization units. The central manifold may also be in fluid and electrical communication with the selected number of pressurization units. The central manifold may also be configured to deliver the fluid to each of the pressurization units, receive high-pressure fluid from the pressurization units, and combine the high-pressure fluid to deliver it to a well head.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE FIGURES

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to a manifold system particularly adapted to manage the delivery of power and fluid to a well head for frac operations. In contrast to current approaches, the present disclosure centralizes the delivery of power and also centralizes the delivery of fluid. Moreover, the delivery of power and fluid are also combined allowing for a much more elegant arrangement of equipment on the job site, freeing up space, allowing for better traffic patterns, reducing hazards to onsite personnel and equipment, reducing environmental risks, and allowing for more efficient operations. The combination of the power and fluid supply systems for frac operations creates its own set of obstacles, which are also addressed by the present disclosure. For example, the vibrations from fluid pumping operations may have a deleterious effect on the electrical and/or power supply systems and, accordingly, the present system includes features for managing vibrations. Still other obstacles are addressed as will be apparent from a review of the present disclosure.

Figure 1:
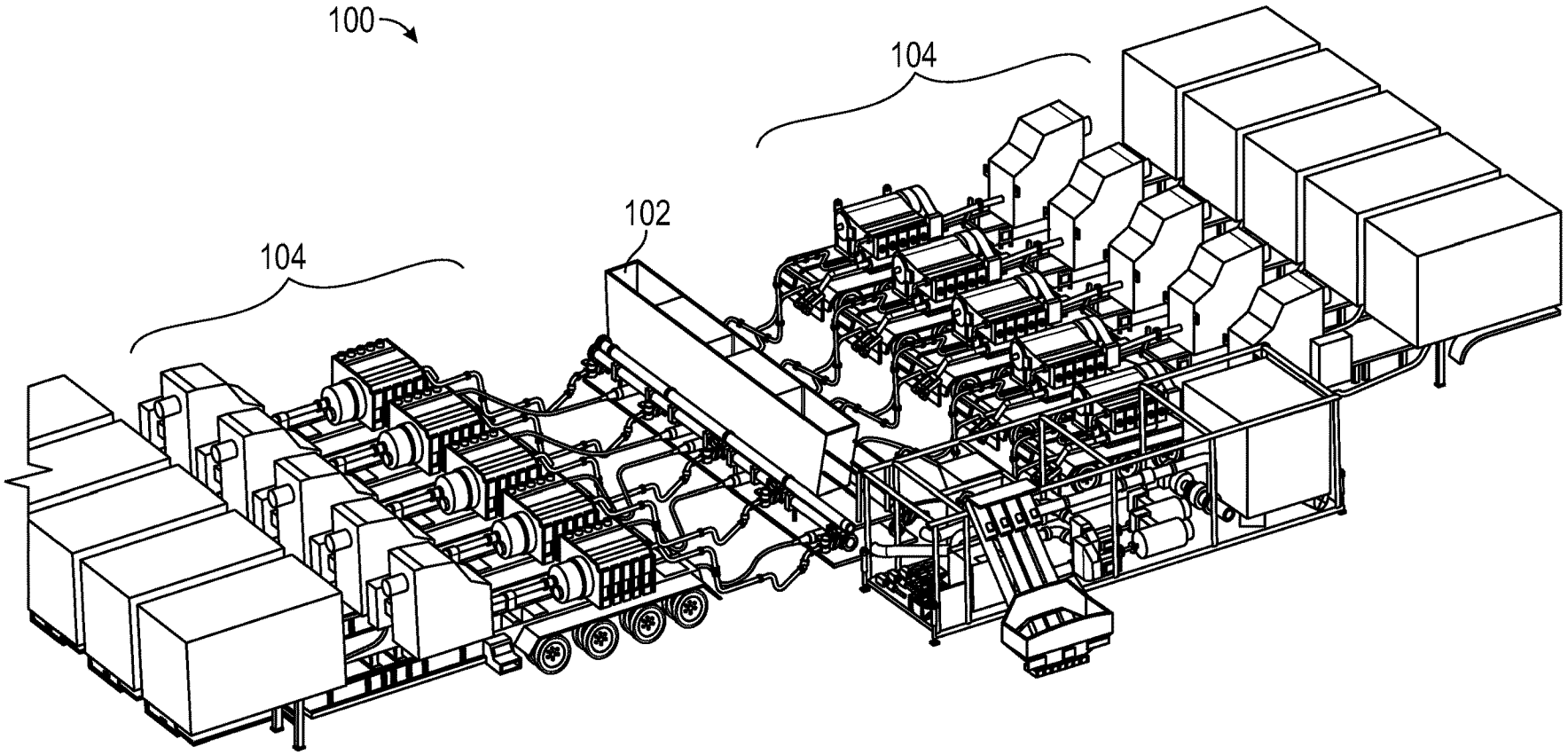
FIG. 1 is a perspective view of an e-frac system having a smart manifold, according to one or more embodiments.
Figure 3:
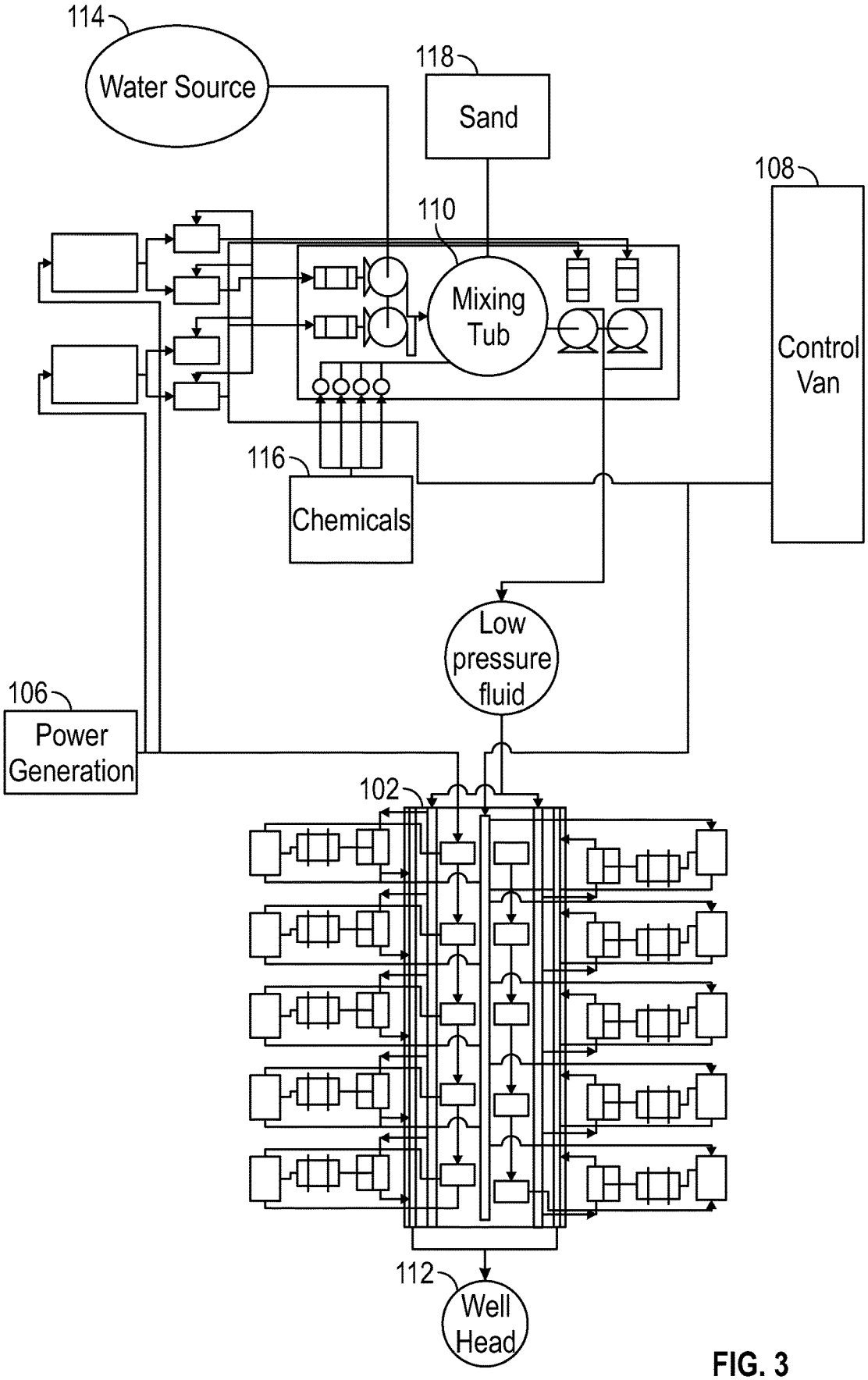
FIG. 3 is a layout showing a layout where a smart manifold is used, according to one or more embodiments.
Figure 4:
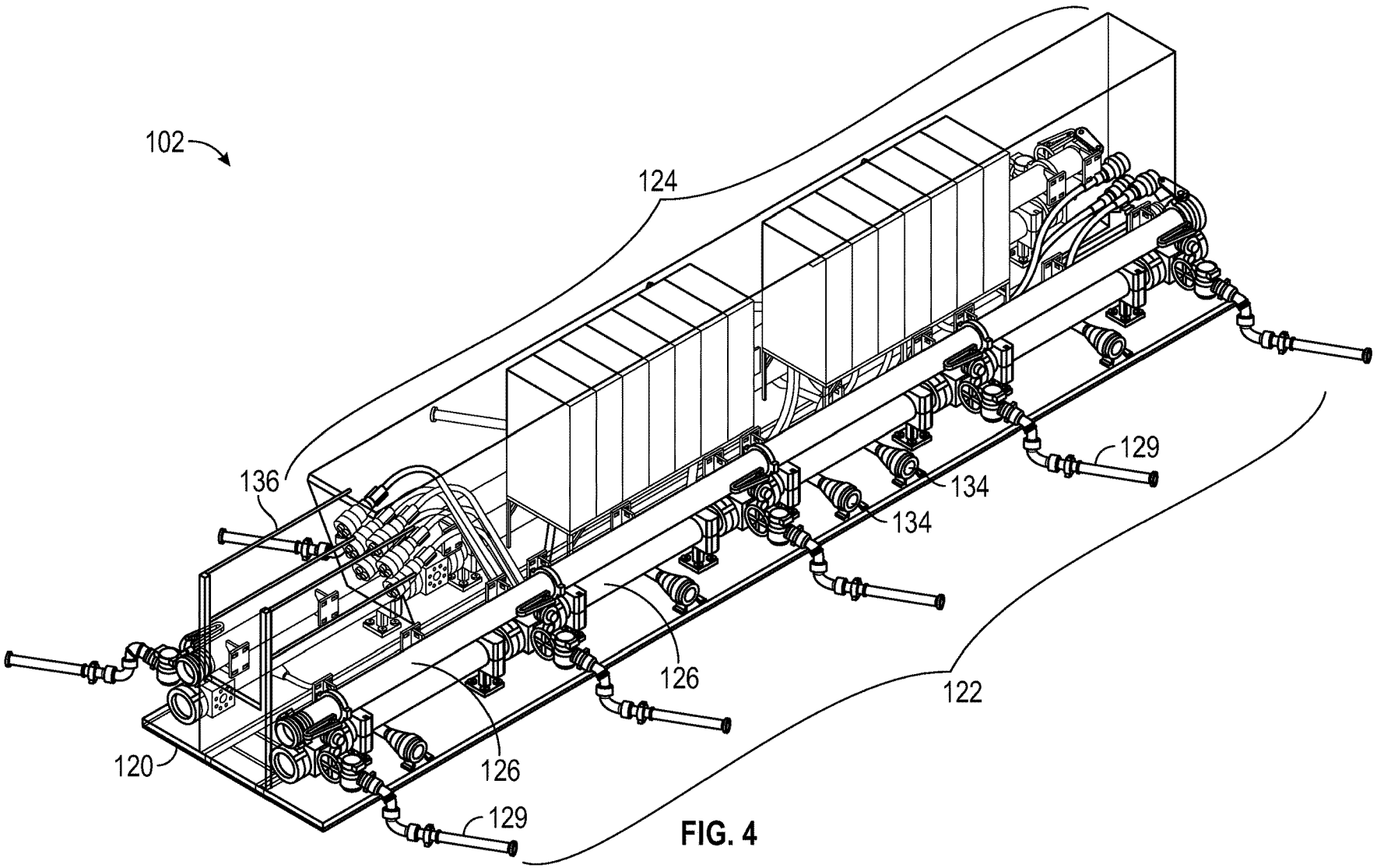
FIG. 4 is a perspective view of a smart manifold, according to one or more embodiments.
Figure 5:
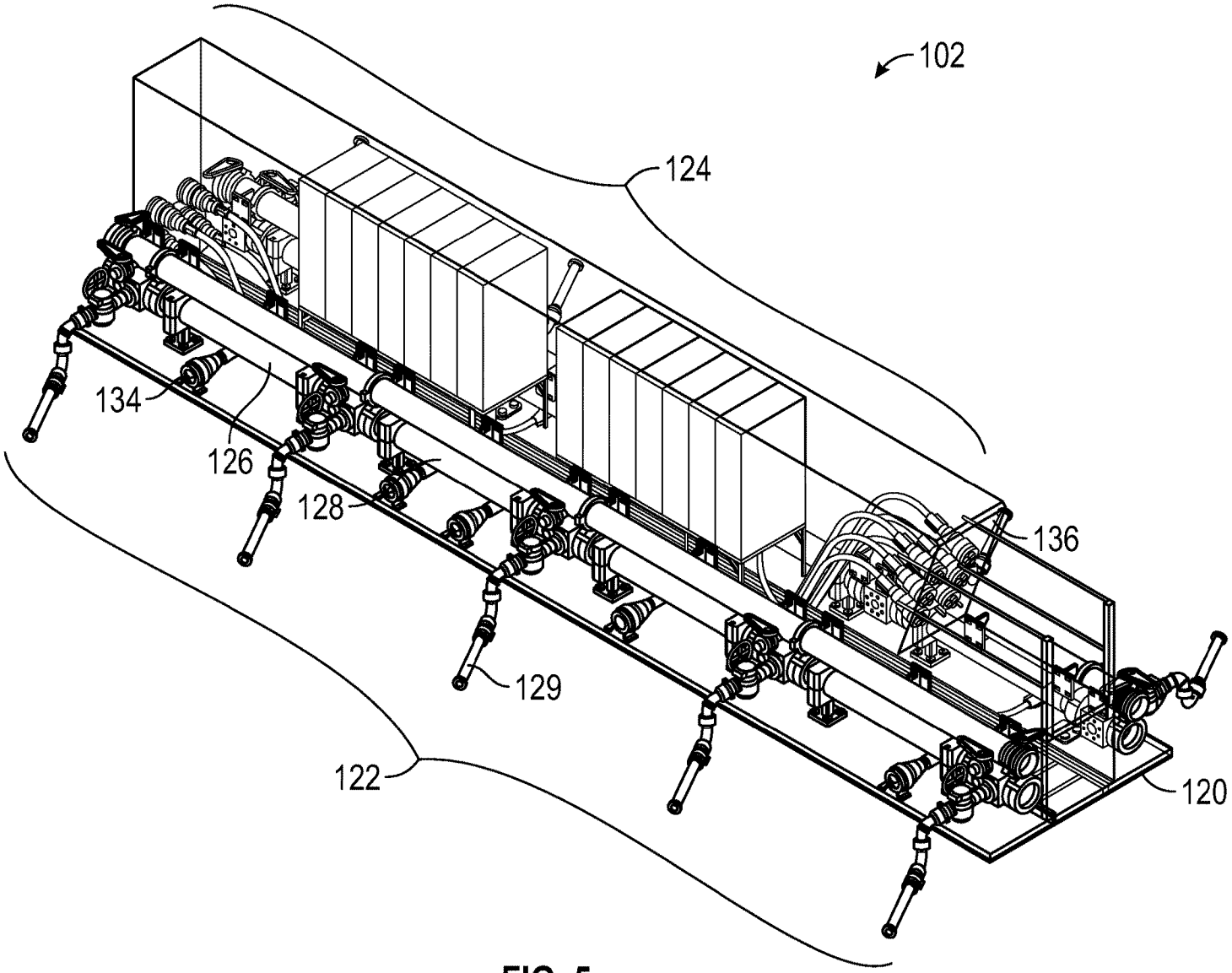
FIG. 5 is another perspective view of the smart manifold, according to one or more embodiments.
Figure 6:
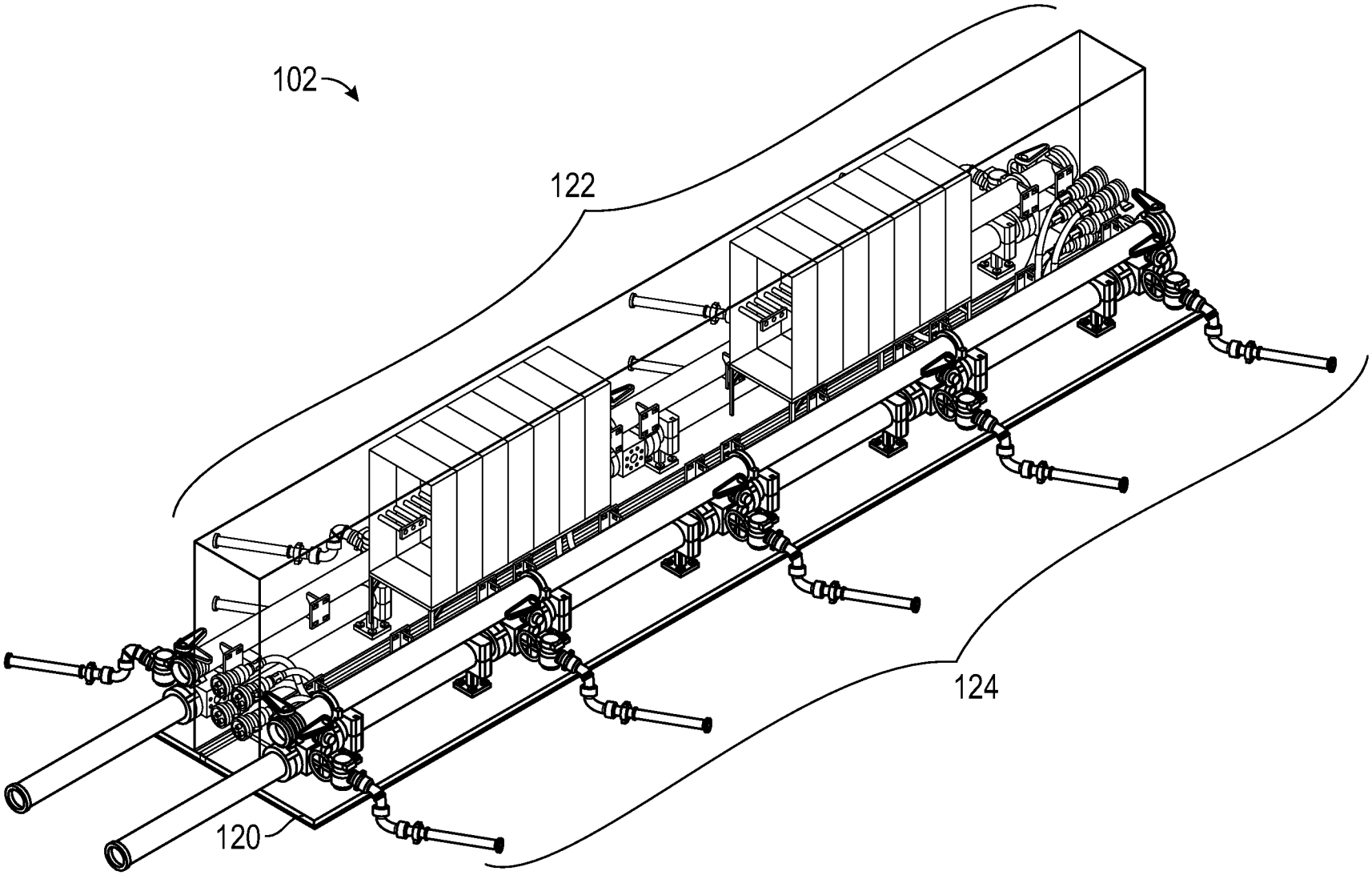
FIG. 6 is yet another perspective view of the smart manifold, according to one or more embodiments.
Figure 7:
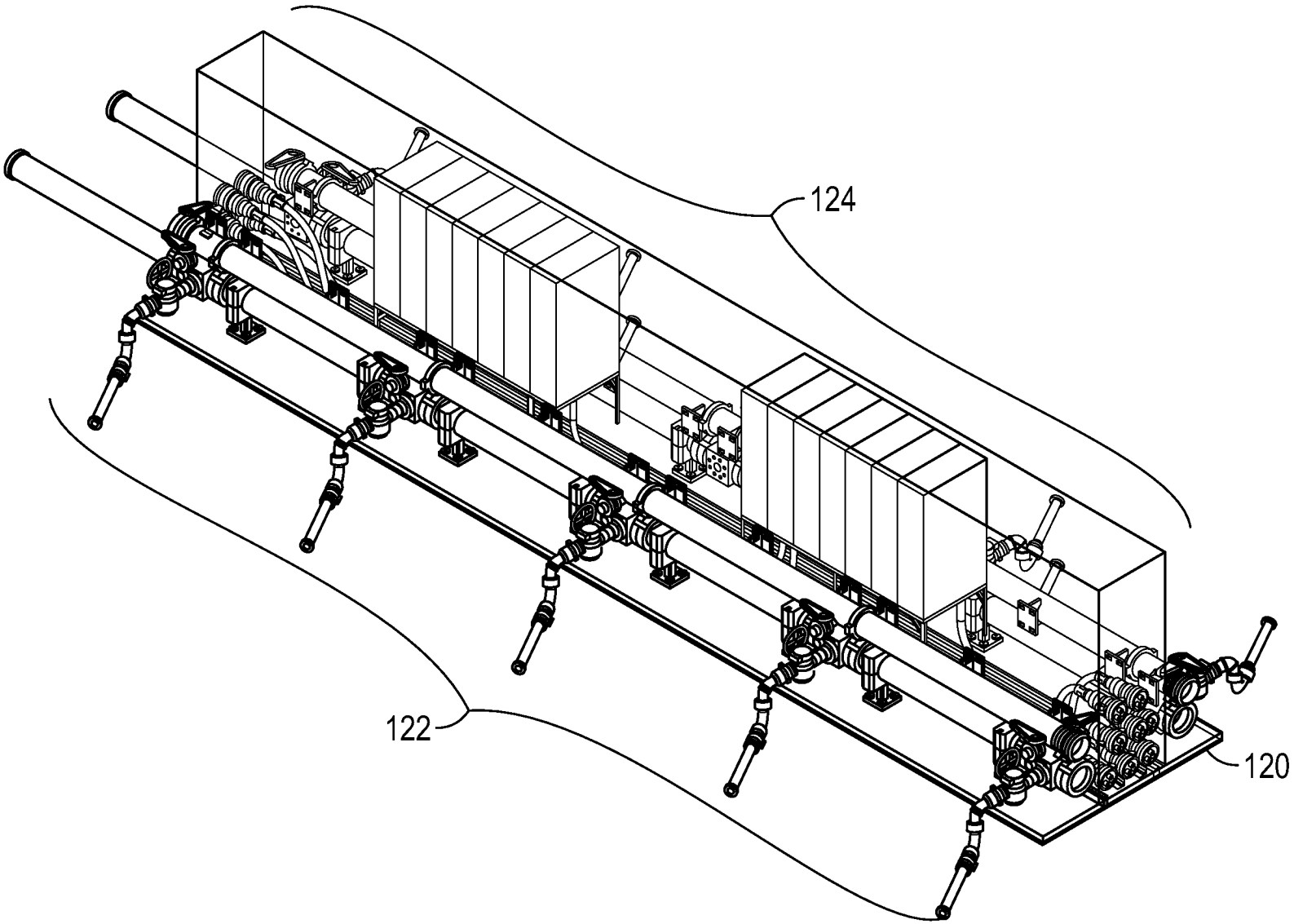
FIG. 7 is still another perspective view of the smart manifold, according to one or more embodiments.

FIG. 1 is a perspective view of an electrically powered frac system 100 ("e-frac system") having a power and fluid manifold system 102, according to one or more embodiments. The primary focus of the present disclosure may be on the manifold system 102 and its relationship to one or more pressurization systems 104 as shown in FIG. 1. However, more broadly, and as shown in FIG. 3, the system may also include a power source 106, a control system 108, and a fluid processing system 110.

As may be appreciated, the power source 106 may include an electrical power source such as a gas turbine generator, grid power, or other electrical power source. The power source may be in electrical communication with the manifold system 102 and, in one or more embodiments, may be in direct electrical communication with the manifold system.

The control system 108 may be configured to control operations of several portions of the frac operation. For example, the control system 108 may control fluid preparation in the fluid processing system. The control system 108 may also control the delivery of the fluid to the manifold system 102, the increase of pressure of the fluid, and the delivery of the fluid to the well head 112. As such, the control system may be in signal communication (wired or wireless) with the fluid processing system 110 and the manifold system 102.

The fluid processing system 110 may be responsible for preparing and delivering low-pressure fluid to the system for use in frac operations. The fluid processing system 110 may include a water source 114, a chemical source 116, and a proppant source 118. The fluid processing system 110 may also include processing equipment for receiving water, chemicals, and proppant from their respective sources and for mixing the several inputs to a desired mixture/slurry for use in frac operations. The fluid processing system 110 may, thus, be in low-pressure fluid communication with the manifold system 102.

The pressurization system 104 may be particularly configured to receive low-pressure fluid and increase the pressure of the fluid to create high-pressure fluid. For example, each pressurization unit in the pressurization system 104 may include a motor, a controller such as a variable frequency drive ("VFD"), and a pump. The motor may drive the pump under the control of the VFD and may pressurize the low-pressure fluid from the fluid processing system to create high-pressure fluid for frac operations. For purposes of receiving the low-pressure fluid and delivering the high-pressure fluid, each of the pressurization units may be in both low-pressure fluid communication and high-pressure fluid communication with the manifold system 102.

Figure 2:
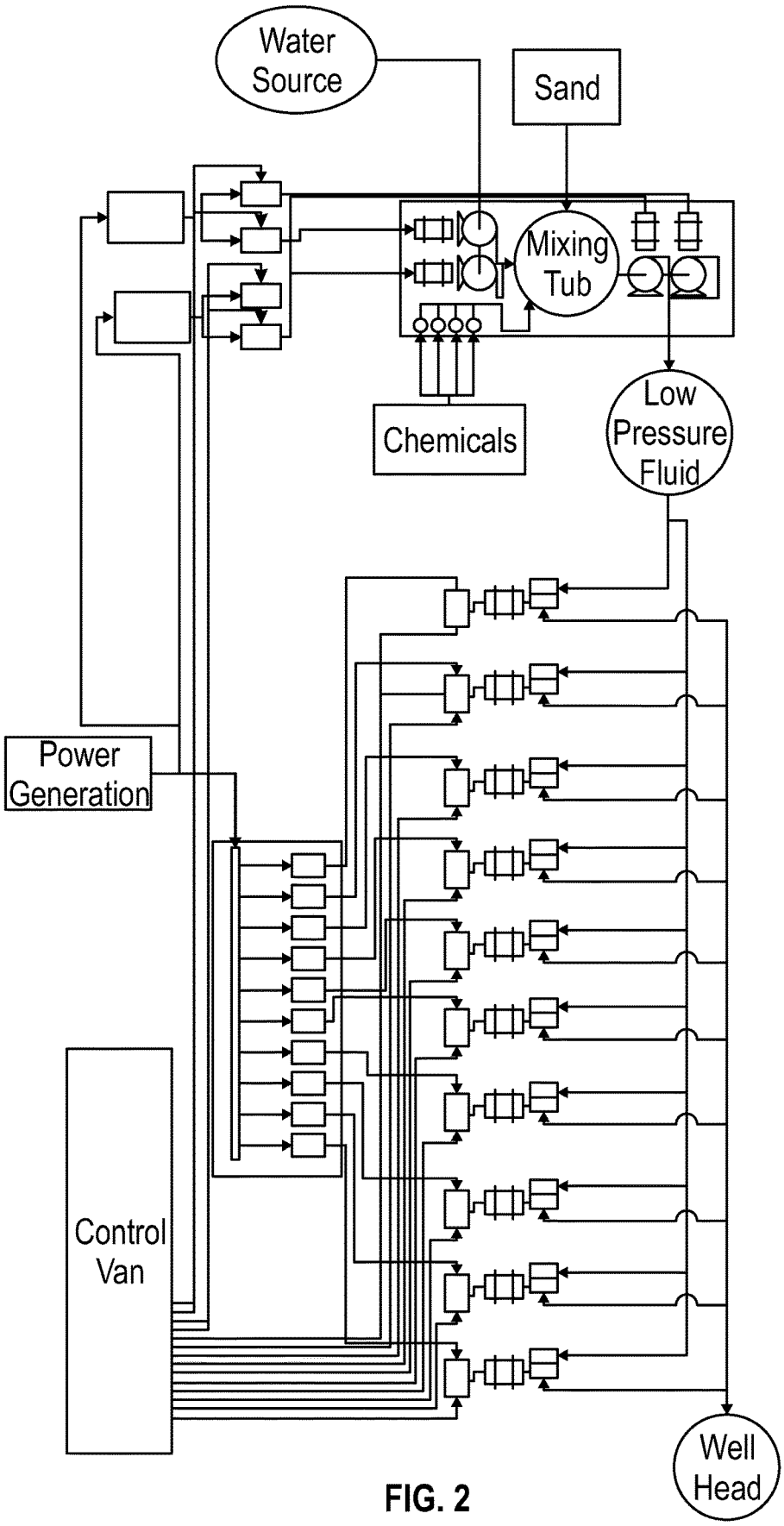
FIG. 2 is a layout showing a layout where a smart manifold is not used.

With this basic understanding of the several functional pieces of a frac system, the manifold system 102 may be described in more detail. The manifold system 102 may receive power from the power source 106, low-pressure frac fluid from the fluid processing system 110, and control signals from the control system 108. Power, fluid, and control signals may each be received via a single power, fluid, or communication line or some other relatively low number of incoming lines. That is, as part of this system, the incoming power/fluid/communication lines may be less than the number of frac pumps or pressurization units being employed and, in one or more embodiments, significantly less. With reference to FIG. 2, a system without the present manifold is shown. As shown, pressurization units may be provided including a VFD, a motor, and a pump. However, for each particular pressurization unit, an incoming power, control, and low-pressure fluid line are present. That is, for example, power may be provided from the power source to a power bus, which may be in electrical communication with each pressurization unit via dedicated switch gear for each unit and a dedicated power line for each unit. Similarly, each unit may have a dedicated control line and a dedicated low-pressure fluid supply line. On site, this results in an array of power and control lines running across the surface of the ground to each of the pressurization units and an array of low-pressure fluid supply lines as well. These individualized connections of each of the inputs for the pressurization systems is cumbersome in the least. The arrays of power, control, and fluid lines takes up site space, limits traffic flow patterns on site, creates electrical and tripping hazards for onsite personnel, and creates environmental hazards where leaks or punctures of the low-pressure lines may occur in a multitude of locations.

In contrast, as shown in FIG. 3, a much cleaner and elegant site may be provide using a manifold described in more detail below. As shown, a single power supply line, a single communication line, and a single low-pressure fluid line may be provided. The low-pressure fluid line may be split to provide for a two-sided manifold design, which may allow for more efficient use of site space, by arranging pressurization units on each side of the manifold. The split for the manifold may occur at or within the fluid processing system or it may occur after the fluid passes to the manifold system. In either, case, the number of fluid supply lines going to the manifold is much less than the number of pressurization units. As shown, the low-pressure fluid may be passed to the manifold and the manifold may route the fluid to each of the pressurization units. The fluid may be pressurized by the pressurization units and may be passed back to the manifold for delivery to the well head. Power and controls may also be delivered to the manifold, which may control and deliver power and signals to each of the pressurization units for this process.

Referring now to FIGS. 4-7, several perspective views of the manifold system 102 are provided. As mentioned, the manifold system may be configured to provide for a centralized location for receiving and distributing electrical power, for receiving and distributing low-pressure fluid, for receiving and relaying control signals and communications, and for receiving and delivering high-pressure fluid to a well head. For these purposes, the manifold system 102 may include a support structure 120, a fluid handling portion 122, and a power management system 124.

The support structure 120 may include a skid, trailer, or other frame allowing for the arrangement of the fluid handling portion 122 and the power management system 124. The support structure 120 may allow the manifold to be transportable by placing on a trailer or by pulling the manifold as a trailer. The support structure may include a deck or other relatively flat surface below the equipment allowing for access to the equipment on the skid or trailer, for example.

Figure 8:
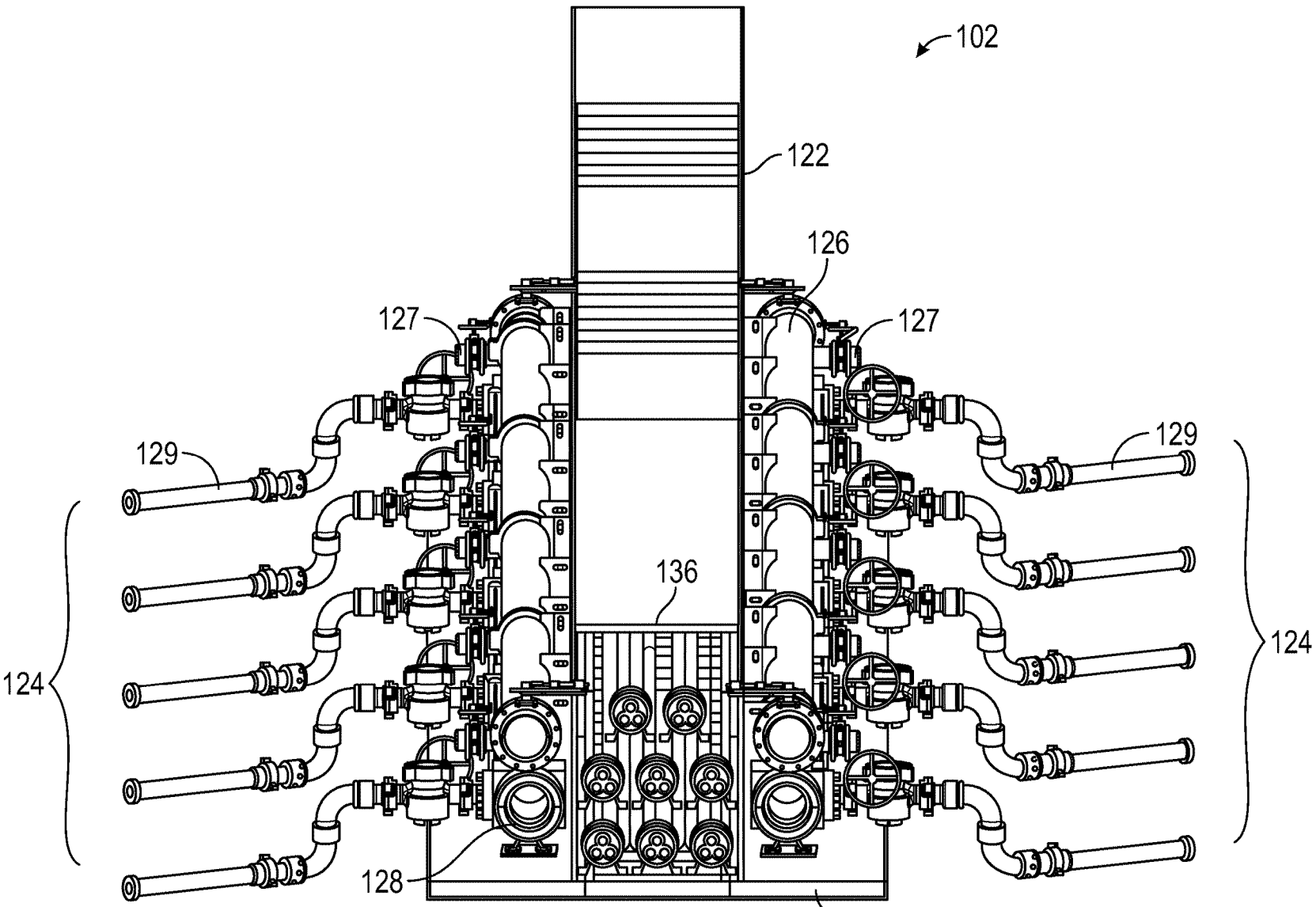
FIG. 8 is a perspective end view of the smart manifold, according to one or more embodiments.
Figure 9:
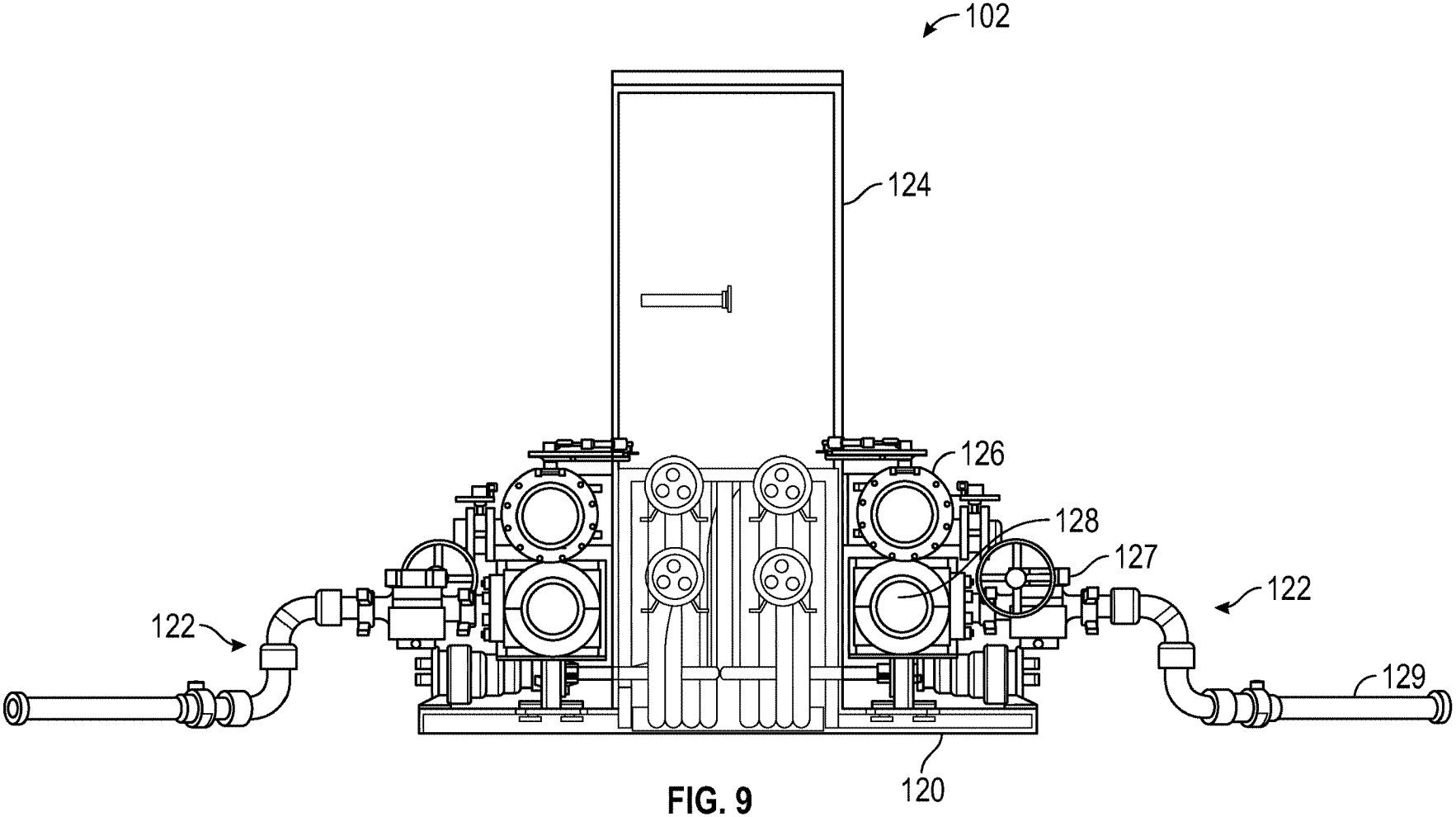
FIG. 9 is a straight end view of the smart manifold, according to one or more embodiments.
Figure 10:
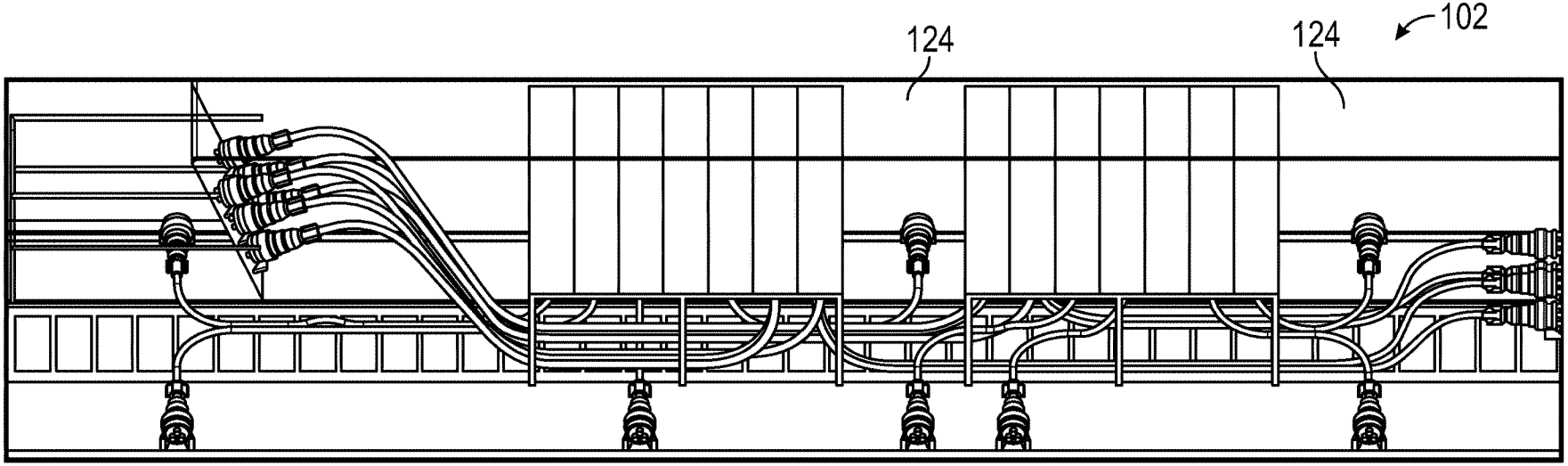
FIG. 10 is a perspective side view of the smart manifold, according to one or more embodiments.
Figure 11:
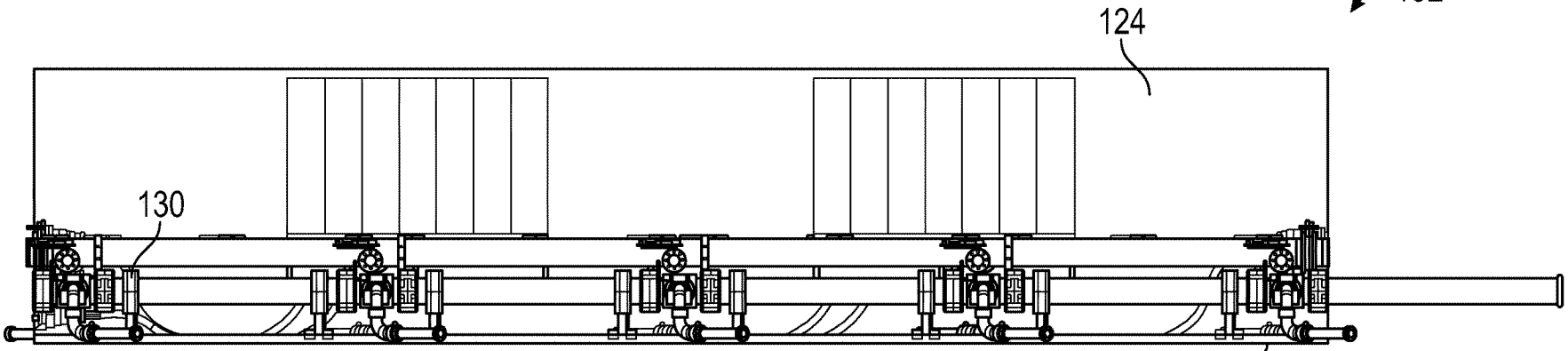
FIG. 11 is a straight side view of the smart manifold, according to one or more embodiments.
Figure 12:
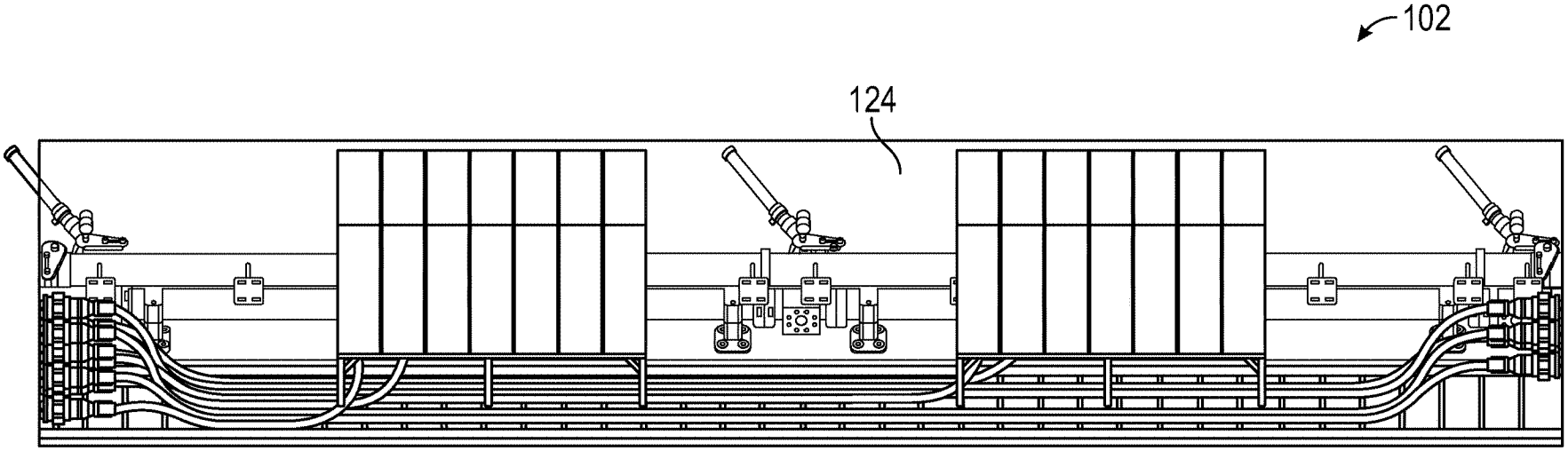
FIG. 12 is a cross-sectional view of the smart manifold, according to one or more embodiments.
Figure 13:
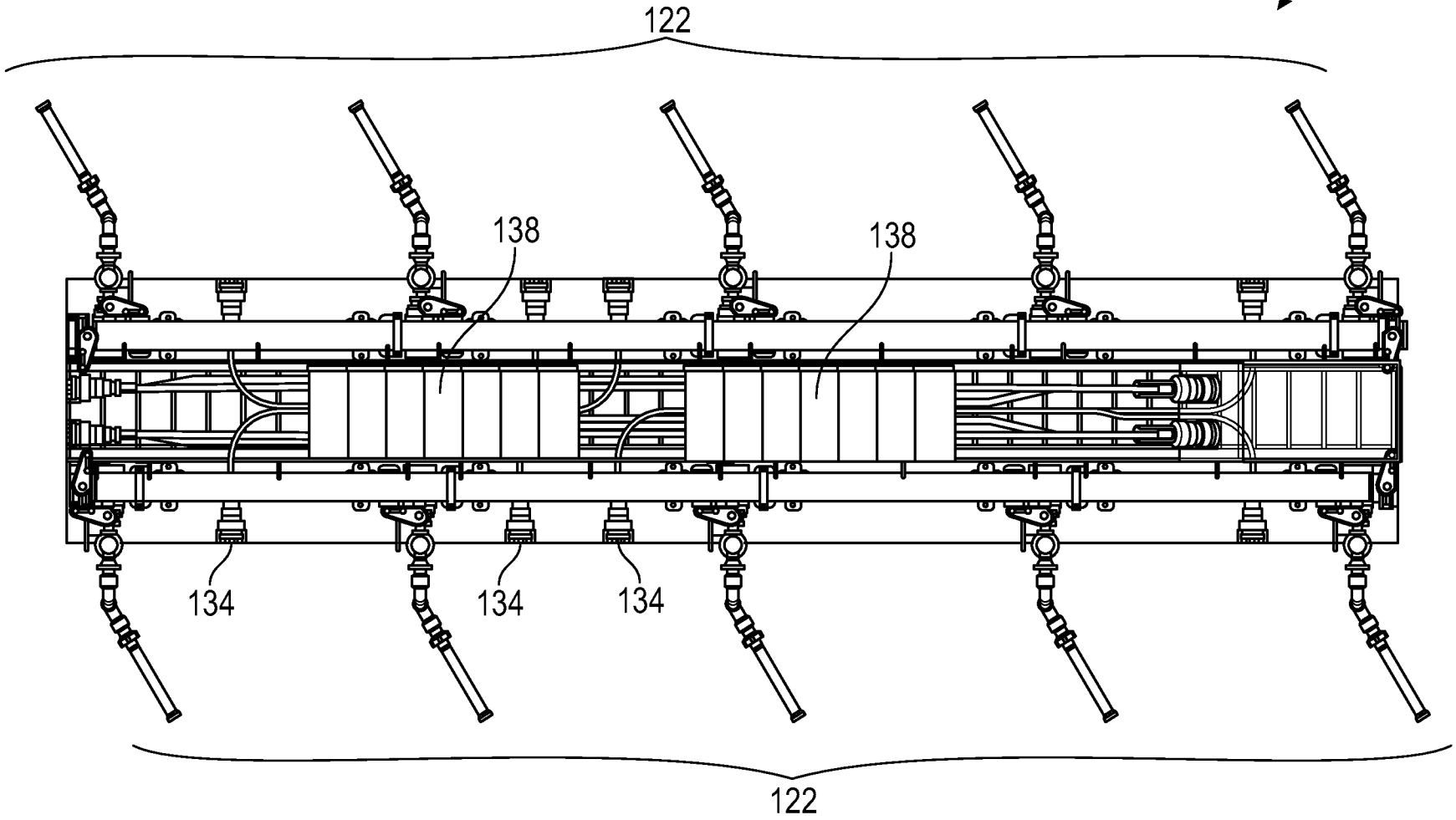
FIG. 13 is a top view of the smart manifold, according to one or more embodiments.
Figure 14:
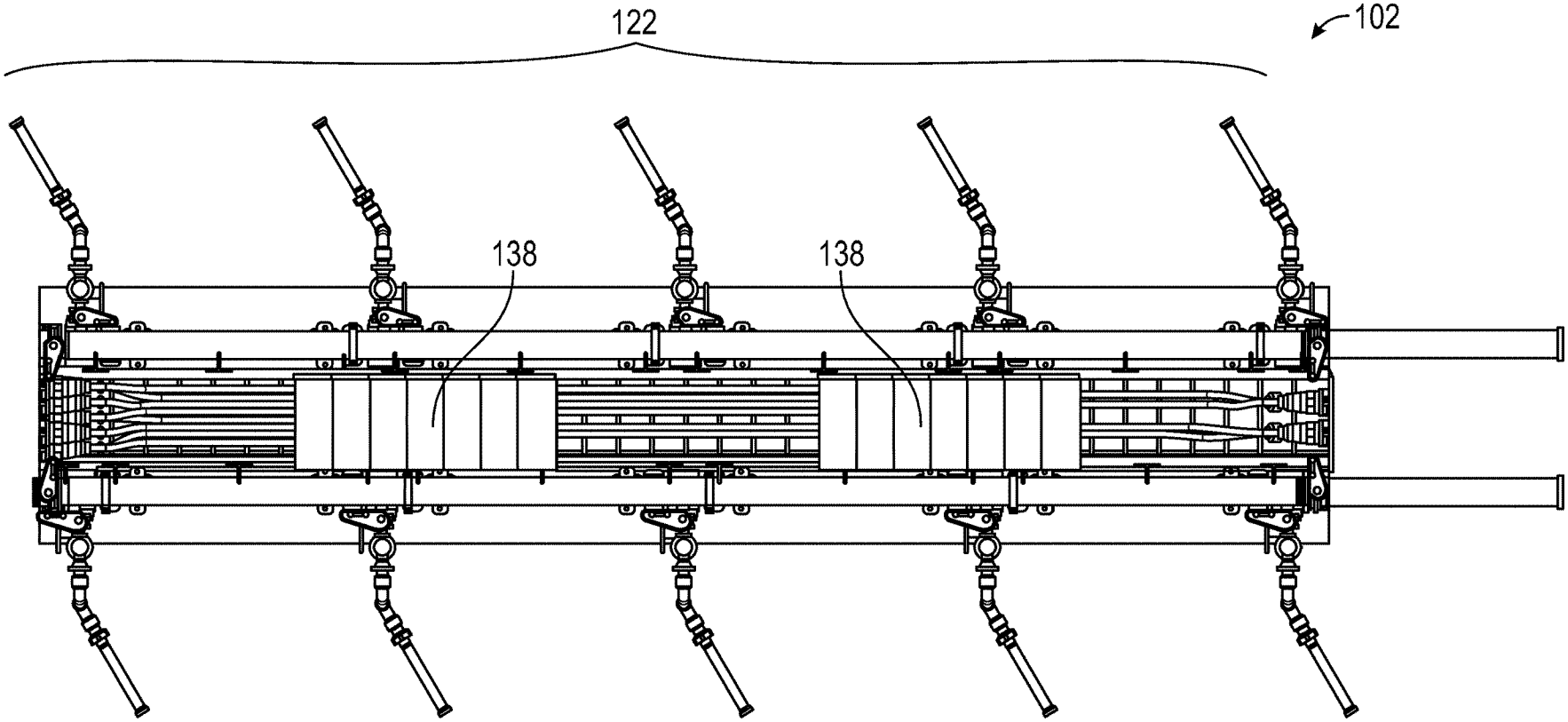
FIG. 14 is another top view of the smart manifold, according to one or more embodiments.

The fluid management portion 122 may be responsible for the above-mentioned fluid related activities. That is, for example, the fluid management system 122 may be configured to received low-pressure fluid from the fluid processing system 110 of the e-frac operation, deliver the low-pressure fluid to the pressurization system 104, receive high-pressure fluid from the pressurization system, and deliver the high-pressure fluid to a well head 112 or other fluid system leading to the well head. As shown in FIGS. 8 and 9, for example, the fluid management system 122 may include a low-pressure manifold 126, low-pressure distribution outlets 127, high-pressure inlet stems 129, and a high-pressure delivery manifold 128.

The low-pressure manifold 126 may be configured for receiving processing fluid from the fluid processing system and making fluid available for delivery to the pressurization system. With respect to the former, the connection of the low-pressure manifold to the fluid processing system may include a close coupling system as described in more detail in U.S. Patent 62/869,459 entitled Close Coupled Fluid Processing System and filed on Jul. 1, 2019, the content of which is hereby incorporated by reference in its entirety. Alternatively, the connection of the low-pressure manifold 126 may include an inlet manifold which may receive low-pressure fluid from the fluid processing system via a series of low-pressure lines. The inlet manifold may combine fluid from the several low-pressure lines into a single or selected number of outlets connected to the low-pressure manifold 126. In either case, the fluid may be pumped from and by the fluid processing unit into the low-pressure manifold 126.

With respect to making the fluid available for delivery to the pressurization system, the low-pressure manifold 126 may extend along the length of the overall manifold system 102 and the low-pressure distribution outlets 127 may be arranged along its length. The low-pressure manifold system 126 may include a relatively long generally stationary pipe, tube, tank, pressure vessel, or other reservoir that may contain the low-pressure fluid as it passes from the processing system 110 until it exits through a low-pressure distribution outlet 127. As shown, the low-pressure manifold 126 may be supported by brackets off of a side wall of an electrical housing, for example. The brackets may include hoop supports for supporting the pipe above a base while allowing the low-pressure manifold 126 to move longitudinally along the length of the overall manifold system 102. That is, while the low-pressure manifold system 126 has been said to be generally stationary, the low-pressure manifold may be allowed to move along the length of the overall manifold system 102 for purposes of assisting with its connection to the processing system 110. In one or more embodiments, the low-pressure manifold system 126 may include a large bore low-pressure pipe such as a 6 inch, 8 inch, 10 inch, or 12 inch diameter pipe. The low-pressure manifold 126 may be a ductile iron, steel, stainless steel, or other material suitable for use with abrasive fluids. In some embodiments, the low-pressure piping may have materials and thicknesses selected based on operating pressures and diameters. The diameters were discussed above and the operating pressures may range from 60 psi to 225 psi, or from 100 psi to 175 psi, or 150 psi. Still other operating pressures may be used to suitably advance the fluid from the processing system to the pressurization units. In one or more embodiments, the low-pressure manifold system may be designed to have a thickness to manage the pressures of the system and a corrosion allowance may be added to allow for corrosion to develop without compromising the operation of the low-pressure manifold. In one or more embodiments, a low-pressure manifold may be provided along each side of the overall manifold 102 to supply fluid to pressurization systems arranged on each side of the manifold system.

The low-pressure distribution outlets 127 may be arranged along the length of the low-pressure manifold 126. The low-pressure distribution outlets 127 may include elbows, tees, or other fluid pipe features allowing fluid to flow out of the low-pressure manifold and into a connected pipe or line. Since the fluid is at low pressure, flexible lines or other user friendly lines may be used to deliver the low-pressure fluid to the pressurization system. The low-pressure distribution outlets 127 may include one or more control valves to shut off fluid leaving the outlet or to control the rate at which fluid is leaving the outlet. In one or more embodiments, the valve may be digitally or otherwise electronically controlled by the control system.

After leaving the low-pressure distribution outlets 127, the fluid may be pressurized by a pressurization unit and returned to the overall manifold system via high-pressure inlet stems 129. Here, and in contrast to the low-pressure distribution outlets 127, the fluid may be at high-pressure and particular plumbing elements may be provided to manage the pressures while remaining flexible as to the position of the pressurization units. That is, and as shown best in FIG. 9, the high-pressure inlet stems 129 may include articulable stems having a connection stem and one or more elbows having swivel joints. The swivel joints may allow the elbows to rotate relative to one another allowing the connection stem to be positioned in a variety of positions to accommodate a respective pressurization unit. As shown, the high-pressure inlet stems 129 may also include a pressure regulating and/or shut off valve leading to the high-pressure delivery manifold 128.

Like the low-pressure manifold 126, the high-pressure delivery manifold 128 may extend along the length of the overall manifold 102 and may be in fluid communication with the high-pressure inlet stems 129. The high-pressure delivery manifold 128 may be a relatively long generally stationary pipe, tube, tank, pressure vessel, or other reservoir that may receive the high-pressure fluid from the high-pressure inlet stems and contain it and deliver it to and/or toward the well head. The high-pressure delivery manifold 128 may be a relatively large bore pipe such as a 6 inch, 8 inch, 10 inch, or 12 inch pipe, for example. In one or more embodiments, the high-pressure delivery manifold may be sized to accommodate regulatory requirements limiting high-pressure fluid flow velocity to 30 ft/s. That is, the bore diameter may be selected to provide the desired amount of fluid while maintaining the velocity of the fluid below 30 ft/s.

The high-pressure manifold 128 may be a relatively thick walled element to manage and contain the high-pressure fluid. For example, thickness of the high-pressure pipe may be selected based on the diameter of the pipe and pressures ranging from approximately 10,000 psi to 20,000 psi, or from 12,500 psi to 17,500 psi, or 15,000 psi. The high-pressure manifold may be a ductile iron, steel, stainless steel, or other material suitable for use with abrasive fluids. In one or more embodiments, the high-pressure manifold may be designed to have a thickness to manage the pressures of the system and a corrosion allowance may be added to allow for corrosion to develop without compromising the operation of the high-pressure manifold. In one or more embodiments, a high-pressure manifold may be provided along each side of the overall manifold to supply fluid to well head from pressurization systems arranged on each side of the overall manifold system.

Figure 15:
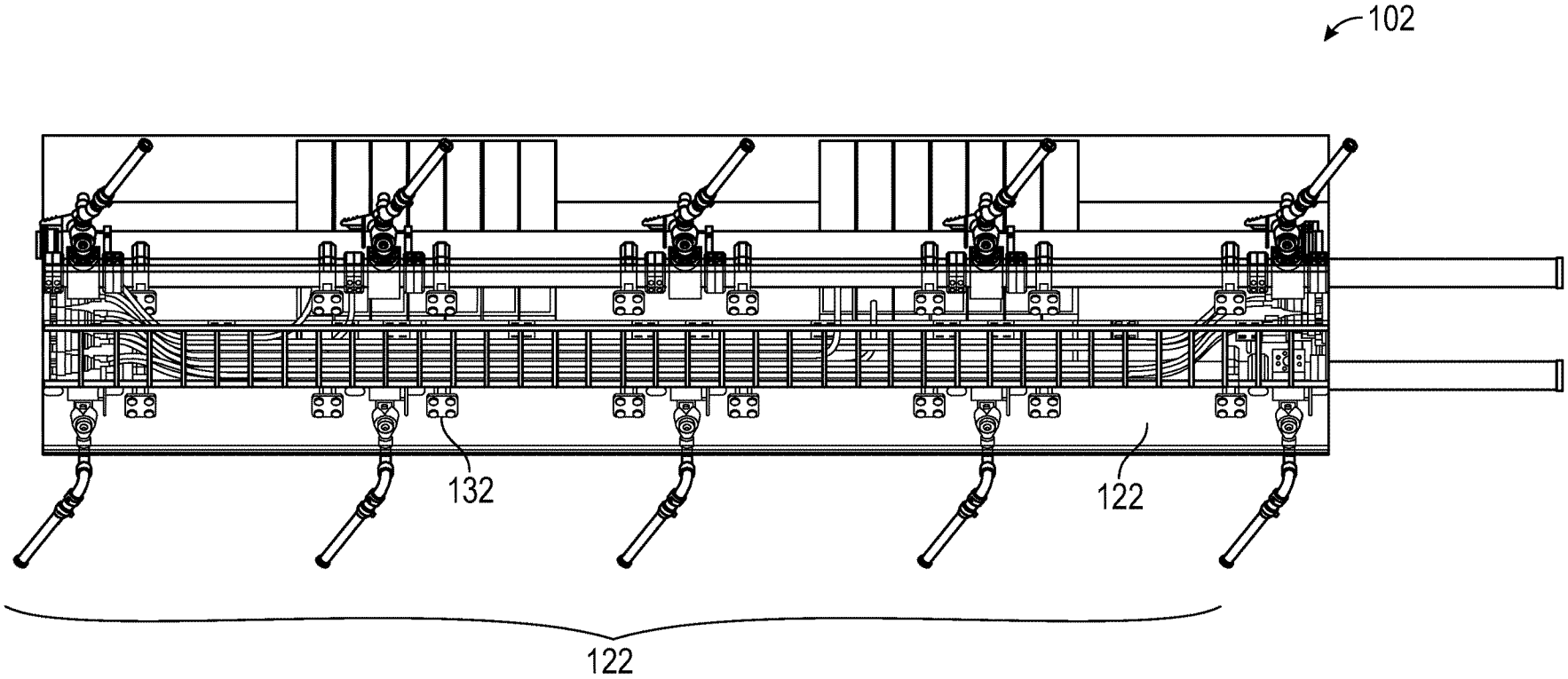
FIG. 15 is a bottom view of the smart manifold, according to one or more embodiments.

The high-pressure delivery manifold 128 may be supported off of a base or other structure and may include vibration isolators for reducing or minimizing the vibratory effect of the high-pressure delivery system. That is, vibrations from the motors and pumps of the pressurization system may propagate along the high-pressure inlets and into the high-pressure delivery manifold. Moreover, the transfer and flow of the high-pressure fluid may further contribute and/or cause vibration in the system. While the large bore of the high-pressure delivery manifold may help to reduce the potential vibration, some vibration may still exist in the system. As such, support columns 130 may be used to support the high-pressure delivery manifold. Vibration isolators may take the form of vibration absorbing padding where the high-pressure delivery manifold is secured to the columns. For example, the columns may include pipe stands 130 such as those shown in FIGS. 4-7. The pipe stands may include a support post and a bottom clamp and a top clamp. The bottom and top clamps may be secured to one another to secure the manifold therebetween. At the interface between the clamps and the pipe wall, resilient vibration absorbing padding may be provided. Still further, and as shown in FIGS. 9 and 15, for example, the columns themselves may be isolated from the supporting structure using resilient and or other vibration absorbing feet 132.

Turning now to the power management system 124, the manifold system 102 may include a generally centrally located system for receiving power and distributing power to the several pressurization units 104. As shown, the power management system 124 may include a power take off outlet 134 for each of the pressurization units and matched up with each of the sets of low-pressure fluid outlets and high-pressure fluid inlets. As also shown, the power management system may include a power input panel 136 at a front end of the overall manifold system 102. The power input panel may include, for example, 4, 6, 8, 10, or other number of power input plugs or ports. The power input may be approximately 30 Megawatts. For example, an amperage of 1800 at 13.8 kV may be provided.

The power from the input panel may pass to switch gear 138. The switch gear may be adapted to control power to the several power take off outlets allowing power to any given pressurization unit to be cut off and/or switched to a different source of power. For example, switch gear may be provided for each of the power take off outlets. Power from the input panel may be divided for each side of the manifold system, such that each side powers 5 pressurization units. The power passing to each side may pass through switch gear, which may then selectively pass the power on to the power take off outlet depending on whether the switch gear is opened or closed. The switch gear may be Solid Shielded insulated switch gear (SSIS) or Gas insulated switch gear. Still other types of switch gear may be used. The switch gear may be in signal communication with the control system allowing for remotely controlling power to each power take off outlet and allowing selective interruption to each pressurization unit from a remote location. The switch gear may also be selectively opened or closed manually at the switch gear location.

The power take off outlets may receive power from the switch gear and may be adapted for plugging in of a pressurization unit so as to provide power to the pressurization unit. Each power take off outlet may be strategically placed as shown to allow for a local connection. These connections may include an interlock system that does not allow for the operation of the switch gear until operational criteria have been met.

It is to be appreciated that one or more overall manifold systems may be connected end to end to allow for supporting further pressurization units. As shown, one, two, three, four, or more of the incoming lines from the front panel may pass through the system for purposes of supplying power to an additional manifold system. As such, a trailing panel may be provided for electrically coupling a second manifold system to the presently described manifold system to support a larger frac operation.

The control system 108 may include an input panel allowing control signals to be passed from a central control system or control van to the manifold system 102. The input panel may distribute control signals via control lines to each of the pressurization units allowing the several pressurization units connected to the manifold system to be controlled individually and/or collectively. The control system may be in signal communication with the valves on the low-pressure manifold 126 and on the high-pressure delivery manifold 128 to control the effect of each pressurization units on the system and, as such, fully control the frac operation.

The present manifold system 102 addresses several issues. As mentioned, fracturing operations are a challenge from an environmental, logistical, operational, and heath safety and environment (HSE) perspective. These challenges can often be exacerbated by site layout and equipment design issues. By combining the fluid and power management systems, the need for long cable runs between the e-house and fracturing trailer may be reduced, minimized, or eliminated. That is, the system may reduce the total cable requirement external to the fracturing pump manifold system to only the electrical supply. This may allow for reducing the total number of cables run across the well site by 90%, increasing the ability for logistics to navigate and reducing HSE risk. Control circuits may also be distributed in the manifold system, creating a local connection for all fracturing pump operation through the manifold system. These local connections may reduce the risk of crossed connections which may be increasingly helpful in the e-frac operation where moving away from manned equipment and towards remote operation is seen to be valuable and safe.

However, a challenge for combining these two functionalities (i.e., fluid and power) may relate to vibration. Vibration may be presented to the electrical equipment by the pulsation and harmonics developed in the pumping operations. As discussed, this may be managed through two features; reduction of flow velocity and total volume. A reduction in flow velocity reduces a phenomenon which is referred to water hammer. Water hammer occurs when a rapid change in velocity occurs and fluid is forced to change direction. The higher the nominal velocity the greater this effect is. The additional volume also reduced the effect of these pulsations. Due to the compressibility of fluids the fluid has the ability to absorb a % of these pulses.

The system may also include a mechanical solution to reduce the vibration on the electrical componentry. For example, the frame of the manifold system may be isolated from vibration of the fluid system using vibration isolators. These isolators may limit the amount of energy transfer from the mechanical piping to the manifold frame. Additionally, the electrical components may include isolation from the frame of the manifold. This can be managed through rope isolators or other energy transfer isolation techniques.

Various embodiments of the present disclosure may be described herein with reference to flowchart illustrations and/or block diagrams of methods, apparatus (systems), and computer program products. Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A smart manifold for frac operations, comprising:

a support structure;

a fluid management system arranged on the support structure and configured for receiving low-pressure frac fluid from a fluid processing system, delivering the low-pressure fluid to a plurality of pressurization units, receiving high-pressure fluid from the plurality of pressurization units, and delivering the high-pressure fluid to a well head;

a power management system arranged on the support structure and configured for receiving power for frac operations and for delivering power to each of the plurality of pressurization units; and a control system arranged on the support structure and configured for receiving control commands and relaying the control commands to the plurality of pressurization units.

2. The smart manifold of claim 1, wherein the fluid management system includes a high-pressure delivery manifold.

3. The smart manifold of claim 2, wherein the high-pressure delivery manifold comprises vibratory isolators to control vibration.

4. The smart manifold of claim 1, wherein the power management system is further configured for powering an additional smart manifold.

5. The smart manifold of claim 1, wherein the fluid management system includes no more than two fluid inlets.

6. The smart manifold of claim 5, wherein the fluid management system includes a low-pressure fluid manifold.

7. The smart manifold of claim 6, wherein the low-pressure fluid manifold is moveable longitudinally along a length of the support structure.

8. The smart manifold of claim 1, wherein the fluid management system comprises a plurality of high-pressure inlet stems.

9. The smart manifold of claim 8, wherein the high-pressure inlet stems comprise articulable stems having a connection stem, an elbow, and a swivel joint.

10. The smart manifold of claim 1, further comprising a second control system separate from the control system arranged on the support structure, the second control system in communication with the control system arranged on the support structure.

11. The smart manifold of claim 10, wherein the control system arranged on the support structure and the second control system are configured to allow for remotely controlling power to one or more of the plurality of pressurization units.

12. A frac system comprising:

a fluid source configured to combine water, chemicals, and proppant;

a power source configured for generating electrical power;

a control system, configured for controlling the frac system;

a selected number of pressurization units configured to pressurize fluid; and a central manifold;

in fluid communication with the fluid source via a number of fluid lines less than the selected number of pressurization units;

in electrical communication with the power source via a number of power supply lines less than the number of pressurization units;

in communication with the control system via a number of control lines less than the number of control lines utilized between all of the pressurization units;

in fluid, electrical, and control communication with the selected number of pressurization units; and configured to deliver the fluid to each of the pressurization units, receive high-pressure fluid from the pressurization units, and combine the high-pressure fluid to deliver it to a well head.

13. The frac system of claim 12, wherein controlling the frac system includes controlling the pressurization units via the central manifold.

14. The frac system of claim 12, wherein the central manifold is arranged on a skid.

15. The frac system of claim 12, wherein the central manifold comprises a fluid management system with a high-pressure delivery manifold.

16. The frac system of claim 15, wherein the high-pressure delivery manifold comprises vibratory isolators to control vibration.

17. The frac system of claim 15, wherein the fluid management system includes a low-pressure fluid manifold.

18. The frac system of claim 17, wherein the low-pressure fluid manifold is moveable longitudinally along a length of the central manifold.

19. The frac system of claim 12, wherein the central manifold comprises a power management system that is configured for powering an additional central manifold.

20. The frac system of claim 12, wherein the central manifold comprises a plurality of high-pressure inlet stems having a connection stem, an elbow, and a swivel joint.

* * * * *